United States Patent [19]

Hershfield et al.

[11] Patent Number: 4,642,843

[45] Date of Patent: Feb. 17, 1987

[54] DRAPERY TRACK HAVING A ROD RETURN EXTENDER

[75] Inventors: Alan Hershfield, Hialeah; Gary P. Danis, Cape Coral, both of Fla.

[73] Assignee: Superior Linen Company, Inc., Miami, Fla.

[21] Appl. No.: 649,367

[22] Filed: Sep. 11, 1984

[51] Int. Cl.[4] ..... A47H 1/142

[52] U.S. Cl. ..... 16/87.4 R; 16/95 D

[58] Field of Search ..... 16/87.4 R, 87.4 W, 87.6 R, 16/87.6 W, 94 R, 94 D, 95 R, 95 W, 95 D, 95 DW, 96 R, 96 D, 96 L; 160/123, 124, 125, 126

[56] References Cited

U.S. PATENT DOCUMENTS

| | | | |
|---|---|---|---|
| 2,523,888 | 9/1950 | Veitch | 16/87.4 R X |
| 2,966,696 | 1/1961 | Young | 160/126 X |
| 3,234,997 | 2/1966 | Ford | 16/87.4 R X |
| 3,383,733 | 5/1968 | Johnson | 16/87.4 R |
| 3,697,035 | 10/1972 | Baker, Sr. | 16/94 D X |
| 3,788,376 | 1/1974 | Mednick | 160/126 X |

*Primary Examiner*—Fred Silverberg

*Attorney, Agent, or Firm*—Robert M. Schwartz; Edward I. Mates

[57] ABSTRACT

A rod return extender having an elongated base plate with a front flange and an end flange, each flange having a plurality of openings for supporting drapery pins, the rod return extender is inserted into the end of a traverse track assembly such that the front flange supports a drapery pleat and the end flange supports a drapery return. The rod return extender is adjustable by being extended from the end of the traverse track assembly.

10 Claims, 6 Drawing Figures

DRAPERY TRACK HAVING A ROD RETURN EXTENDER

BACKGROUND OF THE INVENTION

1. Field of the Invention.

The present invention relates to drapery systems which are mounted on cut to measure one piece traverse tracks mounted to a wall or the ceiling of a room.

2. Description of the prior art.

It is well known to use a traverse track assembly to install drapery systems. The traverse track is mounted directly to the ceiling or is mounted on brackets attached to the wall and includes a channel within said track. Transport carriers are supported within the track by each carrier's rollers that cooperate with the channel. Each carrier supports a hook which in turn supports the drapery at a particular point. Carrier and hook spaced at equal intervals support the drapery and allow the drapery to be opened or closed as the transport carriers are rolled along the track's channel.

The track supports the entire weight of the drapery system. The carriers must roll within this channel for the opening and closing of the drapery. These carriers must have a smooth and uninterrupted length to roll. Thus the channel is best constructed of one continuous length of material spanning the entire length of the window, wall or opening to be covered; the traverse track extends this entire length.

The end of each drapery includes a "return" which is the small portion at the end of a drapery after the last pleat. This return portion generally wraps around the corner of a traverse track. A return support enhances the general appearance of a drapery. In addition when a black out drapery is used, this return wraps around the traverse track and helps keep out light where the end edge of the drapery meets the interior wall. Thus the return and return support prevent light leaks.

Present traverse track equipment does not provide a device to support this return. The installer must install a return support, which prior to this present invention has been usually mounted as a separate unit directly to the wall.

When installing draperies in a commercial environment, an installer may, for example, do a complete hotel having 200 rooms or more. Each room, or at least each vertical line of rooms, should have the same width (window wall to be covered). But more than often this is not the case.

Therefore, each room must be individually measured, each track must be cut to an exact length and each track must be matched to a specific room during installation. All a very time consuming and labor intensive process.

The present invention will allow the installer to cut the traverse tracks to one length slightly less than the width of the rooms in which the draperies of a given length are to be installed and the traverse track in each room will be individually extended to the desired width which can match exactly the width of rooms varying slightly in width from room to room. Thus the present invention will save an installer a considerable amount of time.

SUMMARY OF THE INVENTION

It is a prime object of the present invention to have an expandable traverse track and drapery assembly.

It is another prime object of the present invention to provide a return support device that will accept and support the drapery pin attached to the drapery return.

It is a third object of this invention that the length of said traverse track be easily and quickly extended.

It is a fourth object of this invention that when the traverse track is extended that it securely holds the draperies in place.

It is another object of this invention that the rod return extender appear to be an extension of the traverse track assembly and carriers.

It is a further object of this invention that the rod return extender be compatible and cooperate with existing traverse track assemblies.

It is yet another object of this invention that it be economical to manufacture and easy to use.

BRIEF DESCRIPTION OF THE DRAWINGS

The invention is illustrated by way of example with the accompanying drawings which form part of this application and which.

DETAILED DESCRIPTION OF INVENTION

Figure 1:
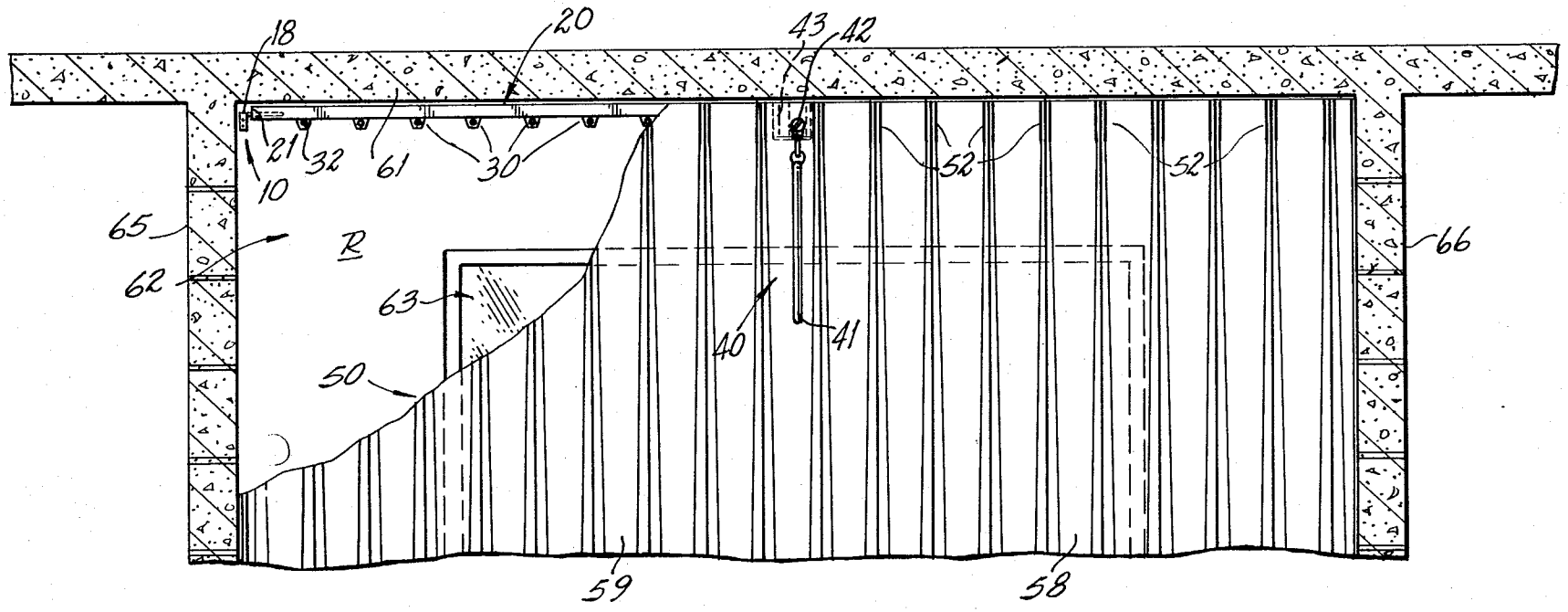
FIG. 1 is an elevational view of a traverse track and drapery system attached to the ceiling of a room, showing adjoining rooms and common walls.

Referring now to FIG. 1, it can be seen that the exposed rod return extender is referred to generally as 10, which cooperates with a horizontal, longitudinally extending traverse track 20, and includes carriers 30, puller assembly 40, drapery 50 and is located within room R.

Track 20, in this preferred embodiment, is attached to ceiling 61 in close proximity and parallel to the rear wall 62 which has window 63. Ends 21 and 22 of track 20 are in close proximity to side walls 65 and 66 respectively. At each end of track 20 is rod return extender 10 and 19 respectively, which will be explained in more detail below. It can be noted that track 20 could be mounted on brackets (not shown) which would be attached to rear wall 62. In addition depending on the area to be covered by the drapery, the ends of the drapery may not be flush to a wall, but may cover an area less that wall to wall.

Figure 2:
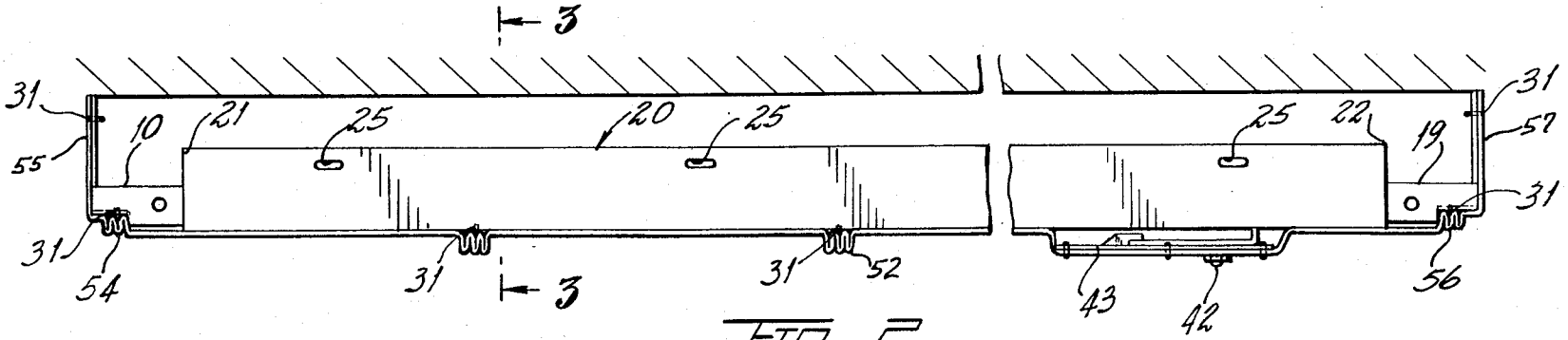
FIG. 2 is an exploded view from the top of the traverse track assembly.
Figure 3:
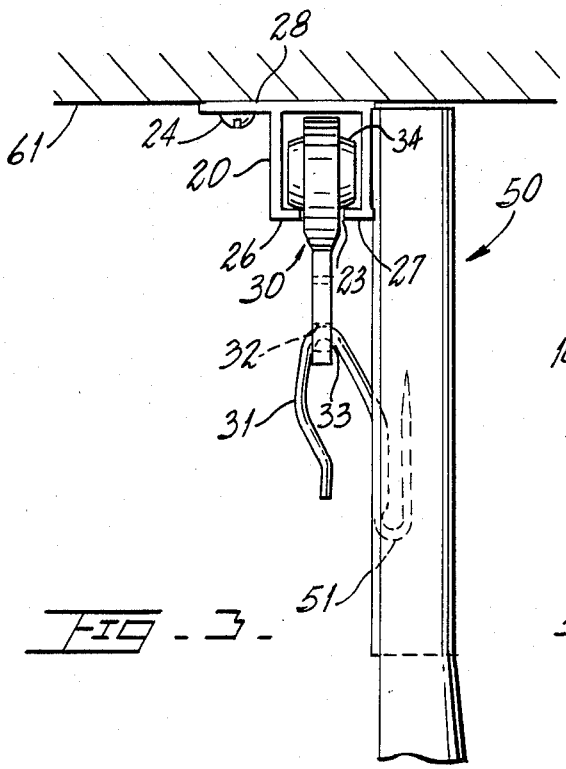
FIG. 3 is a sectional view of the traverse assembly along line 3—3 of FIG. 2.

Track 20 in the preferred embodiment, as shown in cross section in FIG. 3, is a slotted hollow track that includes channel 23 in the form of a slot extending longitudinally along the bottom of track 20, which is formed by rails 26 and 27. Upon these rails 26 and 27, roller 34 of carrier 30 is supported and allows carrier 30 to be moved along and within channel 23. It can also be seen that ledge 28 extends from the top and rearwardly from track 20. At intervals along the length of ledge 28 are openings 25, FIG. 2, to receive screws 24 which are screwed into ceiling 61 to secure track 20 to ceiling 61.

Drapery 50 is attached to carriers 30 by drapery pins 31 as seen in FIG. 3. The height of the drapery is determined by vertical placement of drapery pin 31 inserted into the rear 51 of drapery 50. Drapery pin 31 is supported by opening 32 of carrier 30. Said opening 32 is axially oriented perpendicular to channel 23 of track 20. The weight of drapery 50 urges pin 31 downward, such that apex 33 of drapery pin 31 rests within opening 32 of carrier 30.

Drapery 50 has pleats 52 at regular intervals spaced along its width, shown in FIG. 1. At each pleat 52, drapery pin 31 supports said drapery i cooperation with a carrier 30. Drapery systems are designed either to open from the middle or to open from one side to the other. In the preferred embodiment, the drapery system is center pull, such that the drapery opens from its middle towards each end and similarly closes from each end towards its middle. The drapery has two panels, right panel 58 and left panel 59. Puller assembly 40 includes rod 41 of relatively short length which an operator (person) would use to manually open or close the drapery. Rod 41 is attached by screw 42 to plate 43 which is secured to the leading edge of right drapery panel 58.

Figure 5:
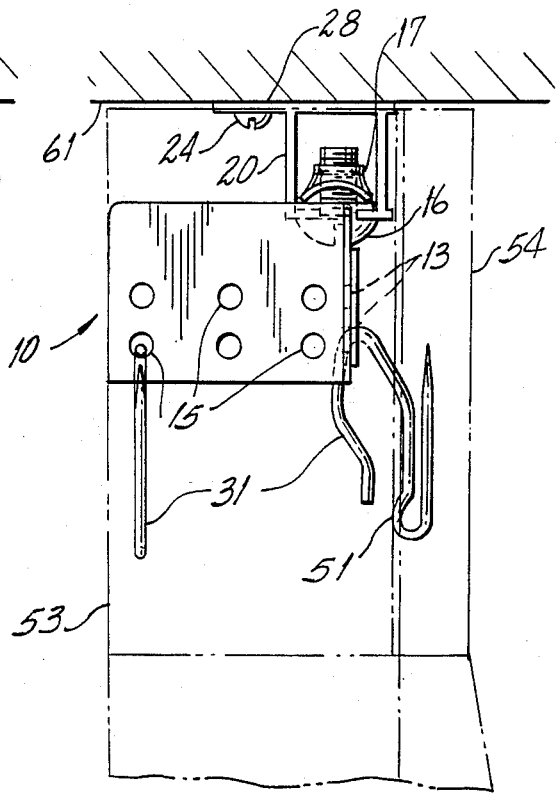
FIG. 5 is an end plan view of the rod return extender mounted within a traverse track.
Figure 4:
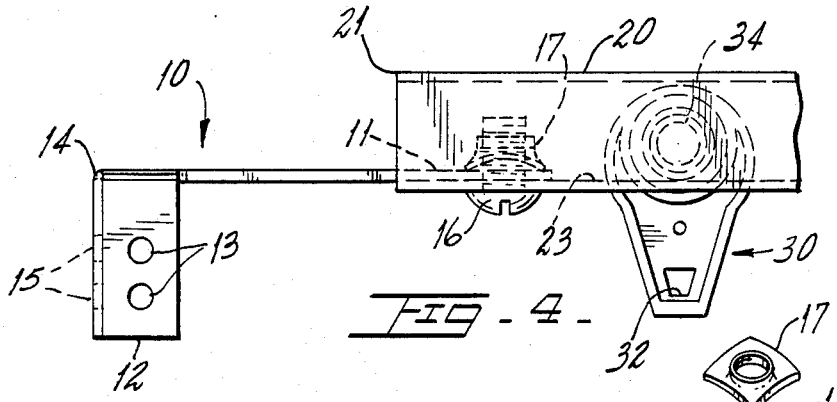
FIG. 4 is a front plan view of the rod return extender, cooperating with an end of the traverse track.
Figure 6:
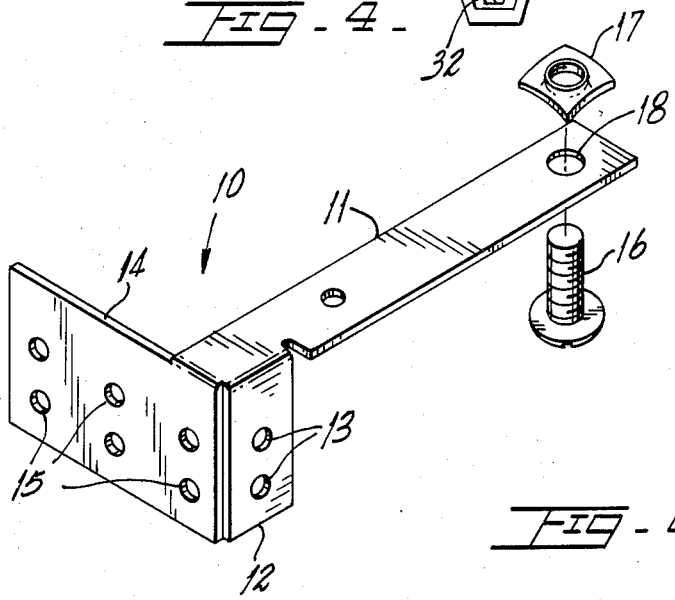
FIG. 6 is a view in perspective of the rod return extender.

The outside ends of each drapery panel include last pleats 54 and 56 which are pinned to a stationary point at each end of track 20. In the preferred embodiment, this stationary point is replaced by rod return extender 10. As shown in FIGS. 4, 5 and 6, rod return extender 10 includes elongated base 11, having front flange 12, end flange 14 and bolt 16 and nut 17, which are connected through opening 18.

The front flange 12 merges with the front side edge of elongated base 11 and extends vertically downward in a plane parallel to track 20, while end flange 14 merges with the end edge of elongated base 11 and extends vertically downward in a plane transverse to track 20. Front flange 12 and end flange 14 are constructed and arranged to form a vertically extending corner therebetween. The last pleats 54 and 56 are pinned to front flanges 12 and the returns are pinned to end flanges 14.

Rod return extender 10 cooperates with the end of traverse track 20 as shown in FIG. 4. Base 11 having a width less than track 20 is inserted within and is capable of longitudinal adjustment along the length of an end of track 20. Bolt 16 and nut 17 are tightened to hold rod return extender 10 securely in place aligned with channel 23 of track 20. It will be noted that base 11 can be extended from end 21 of track 20 to variable lengths. Bolt 16 and nut 17 will correspondingly be tightened closer to end 21 of track 20.

Both front flanges 12 of the rod return extenders at each end of track 20 must face forward. Therefore, there is a left-end rod return extender 10 and a right-end rod return extender 19.

Openings 32 in carriers 30 support drapery pins 31. As seen in FIGS. 4, 5 and 6, a plurality of openings 13 and 15 are located in flange 12 and flange 14 respectively. These openings also support drapery pins 31. It can be seen that the plurality of openings 13 in flange 12 and the plurality of openings 15 in flange 14 are arranged in two rows, an upper row and lower row. Said upper and lower row of openings are used with two types of carriers which have different vertical heights for openings 32 in carriers 30.

Not shown is another type carrier 30 that extends below traverse rod 20 a different length such that the corresponding opening 32 will axially line up horizontally with the top horizontal openings of front flange 12 and end flange 14. Therefore said rod return extender 10 can cooperate with more than one type carrier.

End flange 14 includes a number of vertically spaced openings 15 to accommodate drapery return 55 depending on the amount of drapery width left. Thus, draperies with shorter returns would attach to the openings closest to the front flange 12 and draperies with longer returns would attach to the openings furthest away from front flange 12.

Last pleat 54, FIG. 2 is attached by drapery pin 31 to either of openings 13. It can be seen that flange 12 simulates a carrier 30. Opening 13 performs as if it were opening 32 in carrier 30. The axial orientation of openings 13 are perpendicular to track 20 and channel 23 and is parallel to the axial orientation of opening 32 of carrier 30.

Likewise, drapery returns 55 and 57 are secured to end flange 14 by drapery pins 31 located in one of openings 15 as shown in FIGS. 2 and 5. Again, openings 15 simulate opening 32 of carriers 30. The axial orientation of openings 15 are parallel to track 20 and perpendicular to the axial orientation of opening 32 of carrier 30. Rod return extender 10 and 19 provides a support means for drapery returns 55 and 57.

When installing a drapery system, only an approximate width of traverse track 20 need be determined. Track 20 is cut to a proper length less than the width of rooms in which the track is installed. Rod return extenders 10 are inserted in each end of track 20. The overall length of traverse track including the inserted rod return extenders 10 and 19 20 can easily be extended to exactly match the width of the room or other area to be covered by the drapery. Upon determining this width, the extenders are extended and screw 16 and nut 17 are tightened securing rod return extender 10 and/or 19 in place. The drapery is mounted in the usual manner, rod return extender 10 provides a means to support drapery returns 55 and 57 as well as provide a means to extend the length of traverse traverse track 20.

As shown in FIG. 1, in the preferred embodiment with rod return extenders 10 extended and carriers 30 in place, traverse track 20 including said rod return extenders 10 extend to a length that matches perfectly the length from side wall 65 to side wall 66. Rod return extender 10 is just as effective in a situation where the traverse track is mounted in a less than wall to wall situation Rod return extender 10 can also act as only an extender whereby drapery return 55 is mounted using drapery pin 31 to front flange 12 in openings 13.

Likewise, rod return extender 10 can also act only as a rod return support by mounting last pleat 54 to carrier 30 and not using front flange 12 while still mounting drapery return 55 to flange 14.

While but a single embodiment of the present invention has been here specifically disclosed, it will be apparent that many variations may be made therein, all within the scope and spirit of the invention.

What is claimed is:

1. A traverse track assembly having a horizontally extending longitudinal slotted hollow track having a slot extending longitudinally along the bottom of the track and carriers movably mounted in said slot to support drapery pins along the length of the track, said drapery pins constructed and arranged to hold a drapery, a rod return extender cooperating with an end of said track, said rod return extender comprising an elongated base plate having a width less than that of said track, and slidably mounted inside said track along said slot such that said base plate is movable longitudinally along a longitudinally extending end portion of said track to extend an adjustable longitudinal distance from the end of said track, a front flange merging with a front side edge of said elongated base plate and extending vertically downward therefrom in a plane parallel to said track, an end flange merging with an end edge of said elongated base plate and extending vertically downward therefrom in a plane transverse to said track, and means for releasably securing said elongated base plate to said slot in said track whereby said base plate extends from the end of said track an adjustable longitudinal distance.

2. A traverse track assembly as in claim 1 further including a second rod return extender cooperating with the other end of said track, said second rod return extender comprising a second elongated base plate having a width less than that of said track and movably mounted to said track to be movable axially along the other end portion of said track to extend an adjustable distance from the other end of said track, a front flange merging with a front side edge of said second elongated base plate and extending vertically downward therefrom, an end flange merging with an end edge of said second elongated base plate at the opposite end of said track extending vertically downward in a plane transverse to said track, and means releasably securing said second elongated base plate to said track, whereby said second elongated base plate extends from the other end of said track an adjustable longitudinal distance.

3. A traverse track assembly as in claim 2, further including means to mount said assembly directly to a ceiling.

4. A traverse track assembly as in claim 2, wherein said front flange and said end flange of said first rod return extender are constructed and arranged to form a first vertically extending corner therebetween beyond said one end of said track and said front flange and said end flange of said second rod return extender are constructed and arranged to form a second vertically extending corner therebetween beyond said other end of said track.

5. A traverse track assembly as in claim 4, further including means to mount said assembly directly to a ceiling.

6. A traverse track assembly as in claim 1, wherein said front flange and said end flange are constructed and arranged to form a vertically extending corner therebetween beyond the end of said track.

7. A traverse track assembly as in claim 6, further including means to mount said assembly directly to a ceiling.

8. A traverse track assembly as in claim 1 further including at least one opening in said front flange to support a drapery pin supporting said drapery and a plurality of openings in said end flange, said openings in said end flange being horizontally aligned with said opening in said front flange to permit said return rod extender to support a drapery pin supporting a return portion of said drapery.

9. A rod return extender as in claim 8, wherein said front flange has a pair of vertically aligned openings and said end flange includes a plurality of openings arranged in rows horizontally aligned with the upper and lower of said vertically aligned openings in said front flange.

10. A traverse track assembly as in claim 1, further including means to mount said assembly directly to a ceiling.

* * * * *